US006067684A

United States Patent [19]

Kweon

[11] Patent Number: 6,067,684

[45] Date of Patent: May 30, 2000

[54] TOOTHBRUSH

[75] Inventor: Young-Cheol Kweon, 307-1001, KangChon Apt., Madu-Dong, Ilsan-Ku, Koyang-Si, Kyonggi-Do, Rep. of Korea

[73] Assignee: Young-Cheol Kweon, Rep. of Korea

[21] Appl. No.: 09/230,149

[22] PCT Filed: Jun. 17, 1997

[86] PCT No.: PCT/KR97/00115

§ 371 Date: Jan. 19, 1999

§ 102(e) Date: Jan. 19, 1999

[87] PCT Pub. No.: WO98/03097

PCT Pub. Date: Jan. 29, 1998

[30] Foreign Application Priority Data

Jul. 19, 1996 [KR] Rep. of Korea ..... 96-21267
Oct. 30, 1996 [KR] Rep. of Korea ..... 96-36432

[51] Int. Cl.[7] ..... A46B 9/04

[52] U.S. Cl. ..... 15/167.1; 15/176.5; 15/207.2; 15/DIG. 5

[58] Field of Search ..... 15/167.1, 176.1, 15/176.4, 176.5, 207.2, DIG. 5

[56] References Cited

U.S. PATENT DOCUMENTS

| | | | |
|---|---|---|---|
| 1,578,074 | 3/1926 | Chandler | 15/176.4 |
| 2,618,003 | 11/1952 | Robey . | |
| 4,020,521 | 5/1977 | Velasquez | 15/176.4 |
| 5,027,463 | 7/1991 | Daub | 15/167.1 |

FOREIGN PATENT DOCUMENTS

| | | |
|---|---|---|
| 34 28 860 | 2/1986 | Germany . |
| 24 935 | 11/1986 | United Kingdom . |

*Primary Examiner*—Randall E. Chin
*Attorney, Agent, or Firm*—Fulbright & Jaworski

[57] ABSTRACT

A toothbrush with silicon rubber bristles is disclosed. The bristles are soft and have both a high polishing power and a high water repellency, thus effectively cleaning teeth without injuring one's teeth or gums. The toothbrush consists of a long handle with a longitudinal opening at one end. A brushing head with the silicon rubber bristles is attached to the opening of the handle. The bristles easily remove foreign substances such as food remnants from teeth or gums and effectively brush the inside, outside and top surfaces of each tooth simultaneously, thus saving time while brushing teeth. The bristles include a plurality of finely rugged bristles.

4 Claims, 2 Drawing Sheets

TOOTHBRUSH

TECHNICAL FIELD

The present invention relates, in general, to toothbrushes used for cleaning human teeth and maintaining dental hygiene and, more particularly, to a toothbrush with bristles made from a soft material with both a high polishing power and a high water repellency, thus effectively cleaning teeth without injuring one's teeth or gums and being used for effectively brushing front, canine and molar teeth of different sizes and configurations, and being convenient to a user while brushing teeth.

BACKGROUND ART

As well known to those skilled in the art, several types of toothbrushes, each of which is used for cleaning human teeth and maintaining dental hygiene, are proposed and widely used. Most typical toothbrushes are individually provided with a long handle. A great number of nylon bristles are densely set on one end of the handle, thus forming a brushing head of the toothbrush. A replaceable toothbrush, of which the brushing head is detachably attached to the handle thus being replaceable with a new head when existing bristles are frictionally abraded or deformed, is proposed.

In most typical toothbrushes, the bristles are made from synthetic fiber. For dental hygiene, most dentists advise people to brush one's teeth three times a day within three minutes after breakfast, lunch and dinner. Such repeated tooth brushing action allows the synthetic fiber bristles to injure one's teeth or gums, thus causing the teeth to be sensitive to cold while eating or drinking cold or sour food or beverages. A problem experienced in a known toothbrush with a replaceable head is that the brushing head fails to be securely fixed to the handle and is unexpectedly separated from the handle. The nylon bristles are sharpened at their tips so that the bristles are not free from injuring one's teeth.

Meanwhile, toothbrushes with animal hair bristles. which were typically used at the time of the undeveloped petrochemical industry, do not injure one's teeth or gums. However, the animal hair bristles are problematic in that they are easily removed from the handles.

The animal hair bristles are also expensive and have a low durability so that such bristles increase production costs of the toothbrushes and reduce the expected life span of the toothbrushes. In this regard, the bristles of toothbrushes have been made from synthetic fiber, which is easily prepared and has a high durability.

While a user brushes his teeth using such a toothbrush with the synthetic fiber bristles, the sharpened tips of the bristles physically crush the food remnants stuck on the teeth or lodged between the teeth and remove the food remnants while polishing the teeth.

However, the synthetic fiber bristles may injure one's teeth or gums while brushing the teeth and may cause a rejection symptom of the teeth because the synthetic fiber does not have an affinity for the human body including teeth.

The damage to the teeth caused by such synthetic fiber bristles is more serious than that expected from an organic material such as cloth, leather or fur having a hardness similar to the synthetic fiber bristles.

It is thus preferable to produce the bristles of a toothbrush using organic materials having an affinity for the human body. However, the bristles made from such organic materials are problematic in that they fail to achieve the tooth cleaning effect expected from the synthetic fiber bristles. It is thus necessary to produce a toothbrush using a material, which is not expensive and easily handled during a production process and is free from generating toxic materials while brushing teeth, and has a high durability.

In order to provide an appropriate material for toothbrushes, physical and chemical characteristics of known materials have been actively studied by the applicant of this invention as follows.

A) Crude rubber (natural rubber): crude rubber is typically produced by adding an acid into latex (rubber tree sap) prior to performing a congelation and drying process. Known crude rubbers are classified into various types in accordance with manufacturing process and quality. However, the known crude rubbers are problematic in that they individually include volatile materials laden with a very small amount of impurities such as ash, copper, manganese and nitrogen.

B) Special crude rubber: this rubber is specifically produced from natural rubber in accordance with the use of the resulting special rubber. However, such a special crude rubber has the same problem experienced in natural rubber.

C) Styrene rubber: styrene rubber has been most widely used as it makes up at least 80 percent of marketed and practically used rubbers. This rubber effectively resists aging, fire and frictional abrasion so that it is preferably used for producing tires.

D) Butadien rubber: the amount of gel and ash included in butadien rubber is smaller than that of the other rubbers. However, it is not known whether butadien rubber is harmful to the human body or not.

E) Chloropren rubber: this rubber is chemically manufactured and used for various industrial applications. However, it is not known whether chloropren rubber is harmful to the human body or not.

In addition, a rubber, which is chemically produced and has the same structural formula as natural rubber, is known. However, this rubber is problematic in that it includes poisonous components and has synthetic rubber odor irritating to people.

Other rubbers, such as butyl rubber, nitrile rubber, ethyleneepropylene rubber, acryl rubber, urethane rubber, silicon rubber or fluoric rubber, are known.

The above rubbers, except for the rubbers of which harmfulness to the human body is not known, were subjected to several tests, measuring an affinity for the human body, thermal resistance, low temperature resistance, electric characteristics and consume resistance. As a result of the above tests, silicon rubber is known as the most preferable material for the bristles of a toothbrush, irrespective of expensiveness.

Silicon rubber has a coil structure with a small intermolecular force so that it has high elasticity and compressibility and more preferably resists low temperature in comparison with the other rubbers. Due to the free rotation of the methyl group on the outside of the coil structure, silicon rubber has a unique surface action such as water repellency and separation power, thus being most preferably used in water.

Silicon rubber has the following physical and chemical characteristics.

1. Thermal resistance: silicon rubber is not thermally affected at 150° C. and effectively endures for at least 10,000 hours at 200° C. and at least 1 hour at 350° C. When the silicon rubber is burnt at a high temperature of not less than 500° C. in air, siloxane polymer is cut, causing silica (white silicon) to remain exclusively.

2. Low temperature resistance: silicon rubber loses its elasticity at temperatures of −60 to −70° C., while the other organic rubbers lose their elasticity at temperatures of −20 to −30° C. It is thus known that silicon rubber effectively maintains elasticity at a low temperature at which the other rubbers lose elasticity. Furthermore, a silicon rubber, which effectively maintains its elasticity at an extremely low temperature of about −100° C., is known.

3. Weather resistance: silicon rubber is free from deterioration caused by ozone generated from corona discharge, while the other rubbers are seriously deteriorated by such ozone and lose their desirable characteristics. Silicon rubber is not deteriorated even when it is exposed to ultraviolet rays, wind or rain for a lengthy period of time. This means that a toothbrush made from silicon rubber is not ill-affected by water, saliva or toothpaste.

4. Electric characteristics: silicon rubber has a high electric insulation ($10^{14}$–$10^{16}$ Ω/m) and is stable both in a wide temperature range and a wide frequency range. Silicon rubber effectively maintains its electric characteristics in water since it has a high water repellency. Furthermore, silicon rubber effectively maintains electric insulation even on corona or arc discharge.

5. Thermal conductivity: thermal conductivity ($0.5\times10^{3}$ cal/cm·sec·° C.) of silicon rubber is relatively higher than that of the other rubbers so that a user does not feel heat or coldness from silicon rubber even when the rubber is used at a high or low temperature. In this regard, the silicon rubber may be preferably used at a high or low temperature. The thermal conductivity of silicon rubber may be increased or reduced by appropriately selecting a filler or changing the mixing ratio of the filler during a process of forming the silicon rubber.

6. Moisture resistance: silicon rubber is almost free from impregnation of water (not higher than 1 wt %) even when it is immersed in cold, hot or boiled water for a lengthy period of time. The silicon rubber is not affected by steam. Moisture resistance of the silicon rubber may be further improved by appropriately selecting a vulcanizing agent or carrying out a secondary vulcanization during a process of producing the rubber. Due to such a high moisture resistance, silicon rubber does not become wet under any circumstance.

7. Chemical resistance: silicon rubber has a high chemical resistance so that it is not changed physically or chemically in aniline or alcohol and effectively resists diluted acid or alkali. In a nonpolar organic compound (solvent) such as toluene, gasoline or benzene, the silicon rubber slightly expands in volume (10–15%), but does not change its characteristics. When such a solvent is removed from the silicon rubber, the rubber is restored to its original volume.

8. Resistance to compressive distortion and bending fatigue: silicon rubber has a high resistance to compressive distortion and bending fatigue so that the rubber does not permanently change its configuration at any state but is restored to its original configuration when an external force is removed. Therefore, the bristles of a toothbrush made from silicon rubber are not deformed even when the toothbrush is use for a lengthy period of time. The toothbrush can be thus effectively used until the silicon rubber bristles are frictionally consumed, losing the tooth cleaning effect. It is possible to prepare silicon rubber of a special grade with bending fatigue resistance being increased by 8 to 20 times in comparison with general silicon rubber.

9. Tensile strength: silicon rubber typically has a tensile strength of 14.7 kN/m which is higher than that of other rubbers. The tensile strength of silicon rubber may be increased by 2 or 3 times when a filler or vulcanizing agent is appropriately added to the rubber. Therefore, the silicon rubber bristles are almost completely free from being unexpectedly severed.

10. Fire retardancy: silicon rubber rarely catches fire and is rarely extinguished once it catches fire The fire retardancy of the silicon rubber may be increased by the addition of a small amount of fire retarding agent.

11. Physical inactivity: silicon rubber is physically inactive so that it has an affinity for a living body and rarely causes a rejection symptom in the living body. When the lid of a live vaccine container is made from silicon rubber, it is possible to keep a live vaccine for a lengthy period of time. However, the lid made from another material regrettably causes a live vaccine to be unusable in a short time. In addition, blood rarely congeals on silicon rubber. In this regard, the silicon rubber is preferably used as a material for medical rubber lids, ultrasonic-diagnostic lens, endoscopic hose, catheter, and artificial internal organs. Recently, silicon rubber is also used as an insert for the human body such as an artificial nose bone or artificial breast. The silicon rubber for medical applications is formed into a rubber of a special grade. The typical silicon rubber, which is not colored or impregnated with impurities on purpose, exclusively includes Si—O and is completely transparent. Silicon rubber effectively and selectively allows gas or vapor to pass through so that the rubber is preferably used for medical applications, for example, artificial hearts, artificial lungs and incubators.

12. Inadhesive and anticorrosive power: silicon rubber is inadhesive and highly releasable since it is a stable and chemically inactive compound. Therefore, silicon rubber does not combine with another material, thus being free from self-corrosion or corroding another material. Silicon rubber is preferably used as a material for the fixing roller of a copying machine, a roll of a printer or a roast wax. The silicon rubber bristles of a toothbrush do not allow food remnants to be stuck to the bristles, thus effectively preventing the propagation of bacteria on the toothbrush.

DISCLOSURE OF THE INVENTION

Accordingly, the present invention has been made keeping in mind the above problems occurring in the prior art, and an object of the present invention is to provide a toothbrush, of which the bristles are soft and have both a high polishing power and a high water repellency thus effectively cleaning teeth without injuring one's teeth or gums.

In order to accomplish the above object, the present invention provides a toothbrush comprising: a long handle with a longitudinal opening at one end; and a brushing head attached to the opening of the handle and adapted for brushing teeth, the brushing head being made from a soft material with both a high polishing power and a high water repellant.

In an embodiment, the brushing head includes: a plurality of plate-shaped side bristles adapted for brushing and polishing simultaneously the inside and outside surfaces of each tooth, the side bristles being vertically formed on the opposite sides of the top of the head, with different gaps being individually defined between each pair of opposite side bristles and being reduced stepwisely from the front end toward the rear end; and a plurality of center bristles adapted for brushing and polishing the top surface of each tooth, the center bristles being individually formed at the center of each pair of opposite side bristles, with the height of each of the center bristles being lower than that of each of the side bristles.

In another embodiment, the brushing head includes: a plurality of needle-shaped side bristles vertically formed along the top edge of the head and adapted for removing foreign substances from the junction between teeth; and a plurality of plate-shaped center bristles arranged on the top of the head at positions inside the side bristles, the center bristles being spaced apart from each other at regular intervals.

The brushing head is made from silicon rubber.

BRIEF DESCRIPTION OF THE DRAWINGS

The above and other objects, features and other advantages of the present invention will be more clearly understood from the following detailed description taken in conjunction with the accompanying drawings, in which.

BEST MODE FOR CARRYING OUT THE INVENTION

Figure 1:
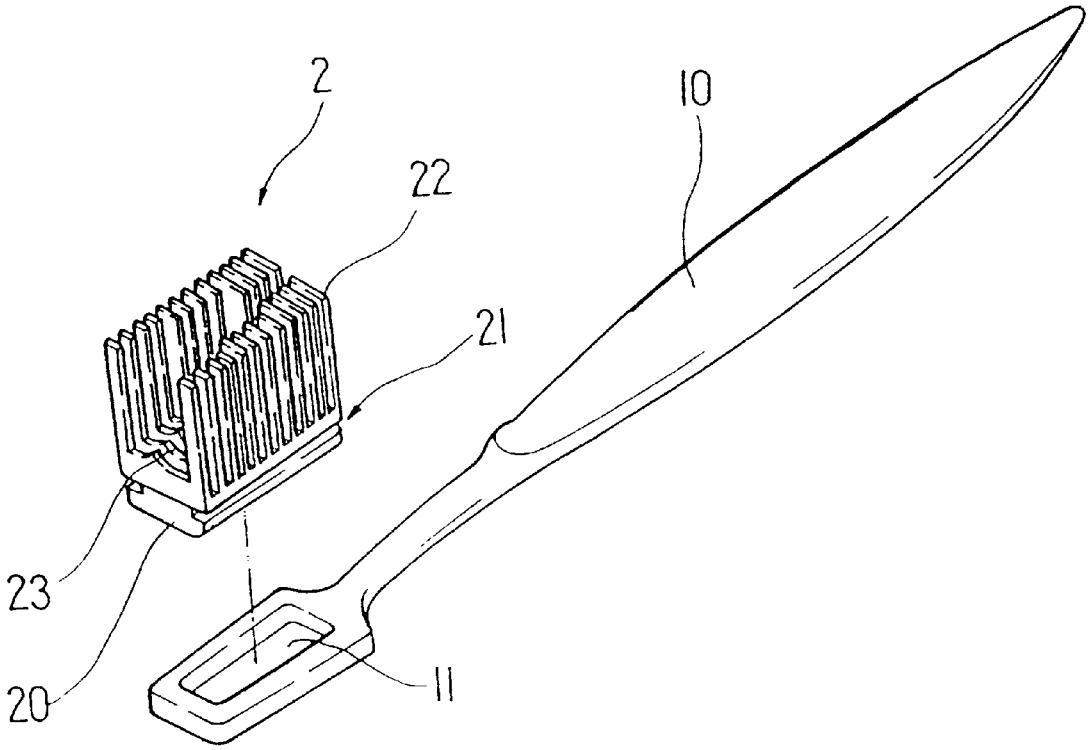
FIG. 1 is an exploded perspective view of a toothbrush according to the primary embodiment of the present invention.
Figure 2:
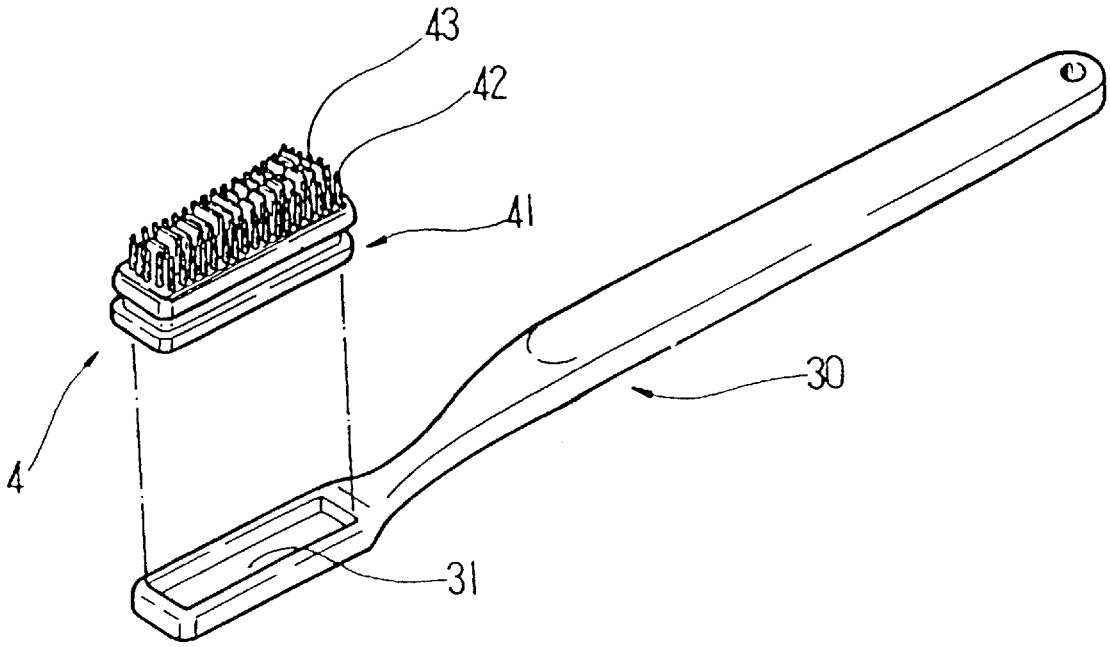
FIG. 2 is an exploded perspective view of a toothbrush according to the second embodiment of the present invention.

FIG. 1 is an exploded perspective view of a toothbrush according to the primary embodiment of the present invention. FIG. 2 is an exploded perspective view of a toothbrush according to the second embodiment of the present invention.

As shown in FIG. 1, the toothbrush of this invention comprises a long handle 10 and a brushing head 2. The handle 10 is provided with a longitudinal opening 11 at one end, while the brushing head 2 is detachably attached to the opening 11 of the handle 10. The above brushing head 2 is made from a soft material with both a high polishing power and a high water repellant. The head 2 consists of a fitting base 20, with a bristle part being integrated with the top of the base 20 into a single structure. That is, the fitting base 20 is connected to the bristle part through a longitudinal rib with a fitting groove 21 being formed at each side of the junction between the base 20 and the bristle part. The head 2 with the fitting base 20 is thus detachably attached to the opening 11 of the handle 10. In the primary embodiment, the bristle part includes two rows of plate-shaped side bristles 22 and a plurality of center bristles 23. The side bristles 22 are used for brushing and polishing the inside and outside surfaces of each tooth simultaneously irrespective of different sizes and configurations of teeth. The side bristles 22 are vertically formed on the opposite sides of the top of the bristle part, with different gaps being individually defined between each pair of opposite side bristles 22 and being reduced stepwisely from the front end toward the rear end. That is, the plate-shaped side bristles 22 in each row enlarge in width stepwisely from the front end toward the rear end. Meanwhile, the center bristles 23 are individually formed at the center of the web between each pair of opposite side bristles 22, with the height of each of the center bristles 23 being lower than that of each side bristle 22. The center bristles 23 effectively brush and polish the top surface of each tooth.

The surface of each of the side bristles 22 is finely rugged, forming an uneven surface of about 50 meshes.

The above-described specific configuration of the bristle part is for achieving the following operational effect.

Human teeth consist of three types of teeth: front teeth for cutting food, canine teeth for tearing food and molar teeth for grinding food. Both configuration and thickness of the teeth are different from each other.

In order to brush one's teeth using a typical toothbrush, it is necessary to separately brush the three surfaces or the outside, inside and top surfaces of each tooth. That is, the typical toothbrush only cleans one surface of each tooth for every brushing action so that the brushing action of the toothbrush has to be repeated in order to separately clean the three surfaces of each tooth which is time consuming. Therefore, if the three surfaces of each tooth can be brushed simultaneously for every brushing action, it is possible to reduce the tooth brushing time. The above object is achieved by the toothbrush of this invention.

That is, the toothbrush of this invention effectively brushes the three surfaces or the outside, inside and top surfaces of each tooth simultaneously for every brushing action, thus improving the tooth brushing effect and being convenient to a user. In the toothbrush of this invention, the bristle part includes two types of bristles: the side bristles 22 and the center bristles 23. The side bristles 22 are arranged on the opposite sides of the brushing head 2 with gaps being reduced stepwisely from the front end toward the rear end, while the center bristles 23 are individually formed at the center of the web between each pair of opposite side bristles 22 with the height of each center bristle 23 being lower than that of each side bristle 22. When one's teeth are brushed with the brushing head 2 being positioned on the top surface of a tooth train, the head 2 effectively brushes the teeth train with the side bristles 22 brushing and polishing both side surfaces of each tooth simultaneously and the center bristles 23 brushing and polishing the top surface of each tooth.

The brushing head 2 is assembled with the handle 10 by fitting the base 20 of the head 2 into the opening 11 of the handle 10. In this case, since the base 20 is made from soft and flexible silicon rubber, the base 20 can be smoothly and easily fitted into the opening 11 even though the base 20 is larger than the opening 11.

Since the toothbrush has a replaceable brushing head 2, an existing head 2 with abraded bristles may be replaced with a new head thus allowing a user to save money. However, the silicon rubber bristles have a high consume resistance so that they are rarely abraded and rarely require such a replacement of the head 2.

In addition, the silicon rubber bristles have a high water repellency so that they almost completely repel moisture from their surfaces and effectively prevent the propagation of bacteria, thus being beneficial to dental hygiene.

The silicon rubber bristles 22 and 23 effectively remove foreign substances such as food remnants from teeth and gums. That is, the above bristles 22 and 23 are contiguously arranged on the brushing head 2 at regular intervals of about 0.5 mm so that the bristles form a suction force at the moment the neighboring bristles are separated from each other while brushing teeth. Due to the suction force, liquid and air inside the mouth are sucked into the fine gaps between the bristles, thus causing the substances such as food remnants to be forcibly removed from the surface of each tooth, the junction between teeth and the junction between the teeth and the gums. In addition, the liquid and air captured in the gaps between the bristles are expelled from the gaps at the moment the bristles are stuck together while brushing teeth so that the teeth cleaning effect is further improved.

Such a force, sucking or expelling liquid and air into or from the bristle part and having an influence upon the teeth cleaning effect, is increased in proportion to the brushing speed. The side bristles 22, arranged on the opposite sides of the head 2, effectively brush both side surfaces of each tooth thus further improving the teeth cleaning effect.

The side bristles 22 with uneven surfaces also provide a tooth wiping effect as expected from coarse cloth such as gauze.

The most important operational effect of the toothbrush according to the primary embodiment is that it effectively brushes the three surfaces or the outside, inside and top surfaces of each tooth simultaneously for every brushing action.

In the second embodiment shown in FIG. 2, the toothbrush has a long handle 30 with the same configuration as that described for the primary embodiment. That is, the handle 30 has a longitudinal opening 31 at one end. In addition, both fitting base 40 and groove 41 of the brushing head 4 according to the second embodiment remain the same as those described for the primary embodiment. However, the bristle part of the head 4 is altered as follows. That is, the bristle part consists of needle-shaped side bristles 42 and plate-shaped center bristles 43. The side bristles 42 are used for effectively removing foreign substances such as food remnants from the junction between teeth so that they are arranged along the top edge of the bristle part. Meanwhile, the center bristles 43 are arranged on the center of the bristle part with regular intervals.

The brushing head 4 with the two types of bristles 42 and 43 is made from silicon rubber so that the bristles 42 and 43 highly resist frictional abrasion and can be effectively used for a lengthy period of time. In addition, the high water repellency of the silicon rubber bristles 42 and 43 causes the bristles to actively splash the water thus further improving the teeth cleaning effect.

In detailed description, the plate-shaped center bristles 43 are contiguously arranged on the center of the bristle part at regular intervals (0.5 mm). Therefore, the center bristles 43 generate a suction force at the moment the neighboring bristles 43 are separated from each other while brushing teeth. Due to the suction force, liquid and air inside the mouth are sucked into the gaps between the bristles 43, thus causing foreign substances such as food remnants to be forcibly removed from the surface of each tooth, the junction between teeth and the junction between the teeth and the gums. In addition, the liquid and air captured in the gaps between the bristles 43 are expelled from the gaps at the moment the bristles 43 are stuck together while brushing teeth so that the tooth cleaning effect of the toothbrush is further improved.

In the same manner as described for the primary embodiment, such a force, which sucks or expels liquid and air into or from the bristle part and has an influence upon the teeth cleaning effect, is increased in proportion to the brushing speed. The center bristles 43 comprise two types of bristles: lower and higher bristles with different heights (5.8 mm and 6.8 mm). The two types of bristles 43 are alternately arranged on the bristle part so that the bristles 43 effectively provide a vacuum effect and further improve the teeth cleaning effect.

Each of the plate-shaped bristles 43 has an uneven surface, thus providing a tooth wiping effect as expected from coarse cloth such as gauze.

Meanwhile, the needle-shaped side bristles 42 individually have a sharpened tip, effectively removing substances such as food remnants from the junction between teeth. Due to elasticity and softness of the silicon rubber, the sharpened side bristles 42 are free from injuring one's teeth or gums.

Industrial Applicability

As described above, the present invention provides a toothbrush, which has a replaceable brushing head suitable for being stably attached to a handle and being easily replaced with a new head, and being effectively used for a lengthy period of time. The bristles of the brushing head are made from a soft material, for example, silicon rubber with both a high polishing power and a high water repellency, so that the bristles easily remove foreign substances such as food remnants from teeth or gums without injuring the teeth or gums. Another advantage of the toothbrush resides in that it effectively brushes the inside, outside and top surfaces of each tooth simultaneously, thus saving time while brushing teeth.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A toothbrush comprising:

a long handle with a longitudinal opening at one end; and a brushing head attached to the opening of the handle and adapted for brushing teeth, being made from a soft material with both a high polishing power and a high water repellant, said brushing head includes:

a plurality of plate-shaped side bristles adapted for brushing and polishing simultaneously the inside and outside surfaces of each tooth, said side bristles being vertically formed on the opposite sides of the top of said head, with different gaps being individually defined between each pair of opposite side bristles and being reduced stepwisely from the front end toward the rear end; and a plurality of center bristles adapted for brushing and polishing the top surface of each tooth, said center bristles being individually formed at the center of each pair of opposite side bristles, with the height of each of the center bristles being lower than that of each of the side bristles.

2. The toothbrush according to claim 1, wherein said brushing head includes:

a plurality of needle-shaped side bristles vertically formed along the top edge of said head and adapted for removing foreign substances from the junction between teeth; and a plurality of plate-shaped center bristles arranged on the top of said head at positions inside said side bristles, said center bristles being spaced apart from each other at regular intervals.

3. The toothbrush according to claim 1 or 2, wherein the surface of each of said plate-shaped bristles is finely rugged, thus forming an uneven surface.

4. The toothbrush according to claim 2, wherein said center bristles comprise two types of bristles, having different heights and being alternately arranged.

* * * * *